United States Patent [19]

Klein

[11] Patent Number: 4,515,005

[45] Date of Patent: May 7, 1985

[54] HYDROPNEUMATIC BLIND RIVETER WITH AUTOMATIC MANDREL CATCHER

[75] Inventor: Günter Klein, Walldorf, Fed. Rep. of Germany

[73] Assignee: GESIPA Blindniettechnik Gesellschaft mit beschränkter Haftung, Frankfurt am Main, Fed. Rep. of Germany

[21] Appl. No.: 363,288

[22] Filed: Mar. 29, 1982

[30] Foreign Application Priority Data

Mar. 31, 1981 [DE] Fed. Rep. of Germany ..... 3112711

[51] Int. Cl.[3] ..... B21D 31/00

[52] U.S. Cl. ..... 72/391; 72/463; 72/453.11

[58] Field of Search ..... 72/391, 453.15, 453.17, 72/453.19, 463, 114; 29/243.53

[56] References Cited

U.S. PATENT DOCUMENTS 3,991,601 11/1976 Duncan ..... 72/391
4,137,747 2/1979 Clarke et al. ..... 72/391

FOREIGN PATENT DOCUMENTS 2154788 11/1971 Fed. Rep. of Germany ..... 72/391
2419190 4/1974 Fed. Rep. of Germany .
2516733 2/1976 Fed. Rep. of Germany .
2537794 3/1977 Fed. Rep. of Germany .
2605648 8/1977 Fed. Rep. of Germany .
2827904 1/1980 Fed. Rep. of Germany .
2941461 5/1980 Fed. Rep. of Germany .

*Primary Examiner*—Francis S. Husar
*Assistant Examiner*—David B. Jones
*Attorney, Agent, or Firm*—Karl F. Ross; Herbert Dubno

[57] ABSTRACT

A riveter has a housing forming an air chamber and a liquid-filled hydraulic chamber adjacent thereto, a head on the housing having a tip and forming a liquid-filled working chamber communicating with the hydraulic chamber, and a working piston in the working chamber and carrying a chuck for grasping a mandrel of a blind rivet. The head and chuck form a passage having a front end opening at the tip and a rear end opening into a mandrel-catching compartment and the piston displaceable in the working chamber between a ready position in which a mandrel of a blind rivet can be fitted into the passage at the chuck with the rivet engaged backwardly against the tip and an actuated position spaced from the tip and wherein the chuck is retracted. An air piston is provided in the air chamber and carries a hydraulic piston displaceable in the hydraulic chamber between an advanced position pressurizing the hydraulic and working chambers and corresponding to a front position of the air piston and a retracted position corresponding to a rear position of the air piston.

16 Claims, 5 Drawing Figures

HYDROPNEUMATIC BLIND RIVETER WITH AUTOMATIC MANDREL CATCHER

FIELD OF THE INVENTION

The present invention relates to a hydropneumatic blind riveter. More particularly this invention concerns such a riveter which automatically catches and holds the rivet mandrel after same has been pulled off its rivet.

BACKGROUND OF THE INVENTION

A standard hydropneumatic blind riveter has a housing forming an air chamber, a liquid-filled hydraulic chamber adjacent the air chamber, and a liquid-filled working chamber communicating permanently with the hydraulic chamber. A working piston is provided in the working chamber and carries a chuck for grasping a mandrel of a blind rivet. This working piston is displaceable in the working chamber between a ready position wherein a mandrel can be fitted into the chuck and an actuated position wherein the chuck is retracted, displacement from the former to the latter position upsetting the rivet and pulling the mandrel from it. An air piston is displaceable between a front and a rear position in the air chamber and subdivides it into a front compartment and a rear compartment. The housing is formed at the front end of the front compartment with a vent and a hydraulic piston in the hydraulic chamber is fixed to and therefore jointly displaceable with the air piston, but between an advanced position pressurizing the hydraulic chamber and corresponding to the front position of the air piston and a retracted position corresponding to the rear position thereof. A valve is provided for admitting pressurized air into the rear compartment and thereby displacing the air and hydraulic pistons into the respective front and advanced positions, while simultaneously displacing the working piston into the actuated position. A spring braced between the housing and the working piston urges same into its ready position. Thus displacement of the air piston by air pressure hydraulically displaces the working piston to upset a rivet grasped by its chuck. When pressurization through the valve of the rear compartment is stopped, this pressure can drain off, normally through the valve which is made with loose tolerances to permit such leakage.

Earlier U.S. Pat. No. 4,050,285 of K. Bosch and M. Fritzenschaft proposes a modification of this system, aimed at speeding up the return of the chuck to the ready position after a riveting operation. A second valve is provided in a second hole in a wall of the rear compartment and blocks air flow from this compartment when the first valve is actuated to pressurize it, but otherwise is open to allow it to depressurize rapidly. This second valve can merely be a high-pressure check valve which only closes at the high operating pressure of the system, opening as soon as pressure in the rear compartment drops slightly as the first valve closes.

It is known to equip such an arrangement at the top or rear end of the riveting head with a mandrel-catching compartment. Thus once the riveting operation is over the device is shaked, or a new rivet is inserted so its mandrel pushes the pulled-off mandrel in the chuck back through a passage in the working piston to this compartment. Either way such an arrangement has been found to slow down a worker, who is normally required to set rivets at great speed with the machine, since blind rivets are often employed in situations, such as aircraft assembly, where large numbers of rivets form the connection.

Accordingly U.S. Pat. No. 4,281,531 of H. Ehmann, W. Bieber, and H. Baier suggests a pneumatic rivet-core or mandrel disposal system that is carried right on the riveter which otherwise is substantially the same as the one described above. In this arrangement means is provided for aspirating air from the mandrel-catching compartment and thereby for forming an air current through the passage to the chuck so as to suck a mandrel pulled from the rivet body into the compartment. Thus suction is exerted at the storage compartment to eliminate a complicated connection of the pneumatic line to the working tip of the riveter, as is known to blow the mandrel back into the compartment.

More specifically this invention has a cover provided with a jet pump having a high-pressure input connected to the source of compressed air that powers the riveter, a low-pressure intake connected to and opening into the compartment, and an output open to the outside. Thus the high-pressure compressed air used to operate the riveter passes through this jet pump to depressurize the storage compartment and create the pressure differential that sucks the mandrel back through the passage into the compartment once it has been separated from its rivet. This suction is continuously present, so it also serves to secure a fresh rivet to the working tip before it is upset.

With this system there is a constant current of air blowing out of the back of the tool with the concomitant noise. A considerable amount of air passes through the riveter, putting quite some strain on the compressor operating it and wasting energy. The suction created at the tip must be sufficient to aspirate the mandrel after it is pulled off the rivet body, a suction much stronger than that necessary to hold a rivet in place on the tool. In fact such powerful suction is frequently disadvantageous, in that it can pick up foreign bodies or suck a not yet upset rivet out from workpieces into which it has been carefully inserted.

OBJECTS OF THE INVENTION

It is therefore an object of the present invention to provide an improved blind riveter.

Another object is the provision of such a blind riveter which overcomes the above-given disadvantages.

A further object is to provide a riveter with automatic pneumatic asipration of pulled-off mandrels, but which is much more energy efficient than the above-discussed prior-art system.

SUMMARY OF THE INVENTION

These objects are attained according to the instant invention in a riveter of the above-described general type, that is having a housing forming an air chamber and a liquid-filled hydraulic chamber adjacent thereto, a head on the housing having a tip and forming a liquid-filled working chamber communicating with the hydraulic chamber, and a working piston in the working chamber and carrying a chuck for grasping a mandrel of a blind rivet. The head and chuck form a passage having a front end opening at the tip and a rear end and the piston is displaceable in the working chamber between a ready position juxtaposed with the tip and wherein a mandrel of a blind riivet can be fitted into the passage at the chuck with the rivet engaged backwardly against the tip and an actuated position spaced from the tip and wherein the chuck is retracted. A generally closed mandrel-catching compartment is provided on the head and the other end of the passage opens into this compartment. An air piston is provided in the air chamber and carries a hydraulic piston displaceable in the hydraulic chamber between an advanced position pressurizing the hydraulic chamber and corresponding to a front position of the air piston and a retracted position corresponding to a rear position of the air piston. Means is provided for pressurizing the air chamber and thereby moving the air and hydraulic pistons into the respective front and advanced positions for pressurizing the working chamber and displacing the chuck from the ready to the actuated position. Thus on displacement of the chuck from the former to the latter position the mandrel is pulled off the rivet at the tip. Valve means is connected between the air chamber and the passage for feeding air under pressure from the air chamber to the nozzle after displacement of the chuck from the ready into the actuated position and for thereby simultaneously sucking the pulled-off mandrel from the chuck back along the passage into the compartment.

Thus the system according to the instant invention has the mandrel-catching system wholly integrated into the riveter. It uses the air already employed to pull the rivet to aspirate its mandrel, and there can be no air flow and suction at the mandrel tip except for the brief instant after a riveting operation when the mandrel is aspirated. Such aspiration is wholly automatic, and can take place with such force that the pulled-off mandrel will be projected with considerable speed back into the compartment.

According to another feature of this invention the device has a nozzle directed in the passage toward the other end and itself connected to the valve means. This nozzle therefore functions like a jet pump to create a powerful backwardly moving current of air in the passage.

This effect is achieved in an arrangement whereby the chuck includes an inner mandrel tube extending back toward the other end and having an end forming part of the nozzle and an outer mandrel tube spacedly surrounding the inner tube and forming the nozzle therewith. A spring is braced between the mandrel tubes and urges the inner tube into engagement with the chuck and the outer tube oppositely. Futhermore the head is provided with a mandrel-tube piston carrying the outer mandrel tube and displaceable therewith toward and away from the tip.

With this arrangement therefore the advantageous features of this invention are integrated in the riveter without appreciably changing its manufacturing cost. Indeed what is saved in energy by not constantly bleeding pressurized air through the device more than compensates for such modest increase in production costs. Such continuous passage of air through the device also, obviously, makes it more likely to become eroded or fouled by foreign matter in the air. What is more the spring prevents the working piston from shifting in the machine when it is not pressurized, thereby avoiding air entry into the hydraulic or working chamber.

According to another feature of the invention, the chuck carries a second air piston distinct from the first-mentioned air piston and the head is formed around the second air piston with a second air chamber distinct from the first-mentioned air chamber. The chuck includes a puller tube fixed to the second air piston and to the working piston and surrounding the mandrel tubes. The valve means is connected between the air chambers and connects same together on displacement of the chuck from the actuated to the ready position. In addition the second air piston is displaceable through an intermediate position corresponding to an intermediate position of the chuck between the chuck and ready positions and the second air chamber is connected to the nozzle between the intermediate position and the ready position of the chuck. In this manner as soon as the operating button of the machine is released, the connection of the rear chamber of the air piston to the high-pressure source is broken and it is connected to the second air chamber, thereby pressurizing it. As the second air piston moves past its intermediate position this second air chamber is in turn connected to the nozzle, emptying its pressurized air through it to create a suction pulse that will surely suck up the mandrel, often in fact impelling it so fast that it pings against the inside of the catcher compartment.

More particularly, this second air chamber has a small-diameter rear portion distal from the tip and in which the second air piston fits snugly and a large-diameter front portion proximal to the tip and larger than the second air piston. The first air chamber is connected to the second air chamber at the rear portion and the piston lies between the portions in its intermediate position. The puller tube is formed with at least one radially throughgoing hole opening into the large-diameter portion. Thus, when the piston is in the front portion, air can flow from the rear portion through the hole into the puller tube. The second air piston is therefore part of the valve means.

According to this invention the inner mandrel tube is removable from the head. Its removal therefore eliminates the mandrel-catching feature, so that actually the mandrels will normally be blown out of the chuck. In such an arrangement the compartment can also be taken off the head.

The catcher compartment according to the invention is open to the atmosphere. To this end it is formed with vent holes smaller in diameter than the mandrel. Such vent holes are normally provided in a wall of the compartment that confronts the other end of the passage, and in an annular array surrounding the wall spot directly aligned with the passage so that aspirated mandrels do not get stuck in the holes. Even though the compartment is normally made of a synthetic resin, this wall is normally made of a more durable metal.

In addition the compartment has an inner part formed with a window and an outer part also formed with a window and movable on the inner part between a position with the windows aligned for emptying out mandrels and a position with the windows out of alignment. This setup makes it easy to empty out the mandrels simply by twisting the outer part on the inner part until the windows align.

The system of this invention may also have valve means for continuously feeding a small quantity of air under pressure to the nozzle, whereby suction is created at the tip. This bleed-type arrangement therefore creates a weak suction at the tip of the device, just sufficient to hold a rivet in place. The amount of leakage needed to produce such minor suction is very small, so that little energy is lost and no discernible sound is created.

The air piston according to this invention subdivides the air chamber into a front air chamber and a rear air chamber and is displaceable between a front position of maximum volume of the rear air chamber and minimum volume of the front air chamber and a rear position of minimum volume of the rear air chamber and maximum volume of the front air chamber. In addition the air piston has a front face exposed in the front air chamber and from which the hydraulic piston projects and a rear face exposed in the rear air chamber and of generally the same effective surface area as the front face. A guide piston extends through the rear air chamber and air piston into the hydraulic piston and is of slightly smaller cross section than the hydraulic piston. This guide piston is fixed to a rear end wall of the rear air chamber and is nearly of the same cross-sectional size as the hydraulic piston projecting from the front face of this air piston to generally equalize the surface areas of the front and rear faces of this air piston.

According to another feature of the instant invention the working piston forms with the head another air chamber pressurizable to urge the chuck into the ready position and the riveter includes conduit means connected to the other air chamber for continuously maintaining same pressurized with a gas. It is the continuous pressurization of this chamber that is effective on the working piston to force the hydraulic and air pistons back at the end of a riviting operation, once the rear chamber is no longer pressurized, to force air from this rear chamber through the nozzle to aspirate the rivet.

DESCRIPTION OF THE DRAWING

The above and other features and advantages will become more readily apparent from the following, reference being made to the accompanying drawing in which.

Figure 1:
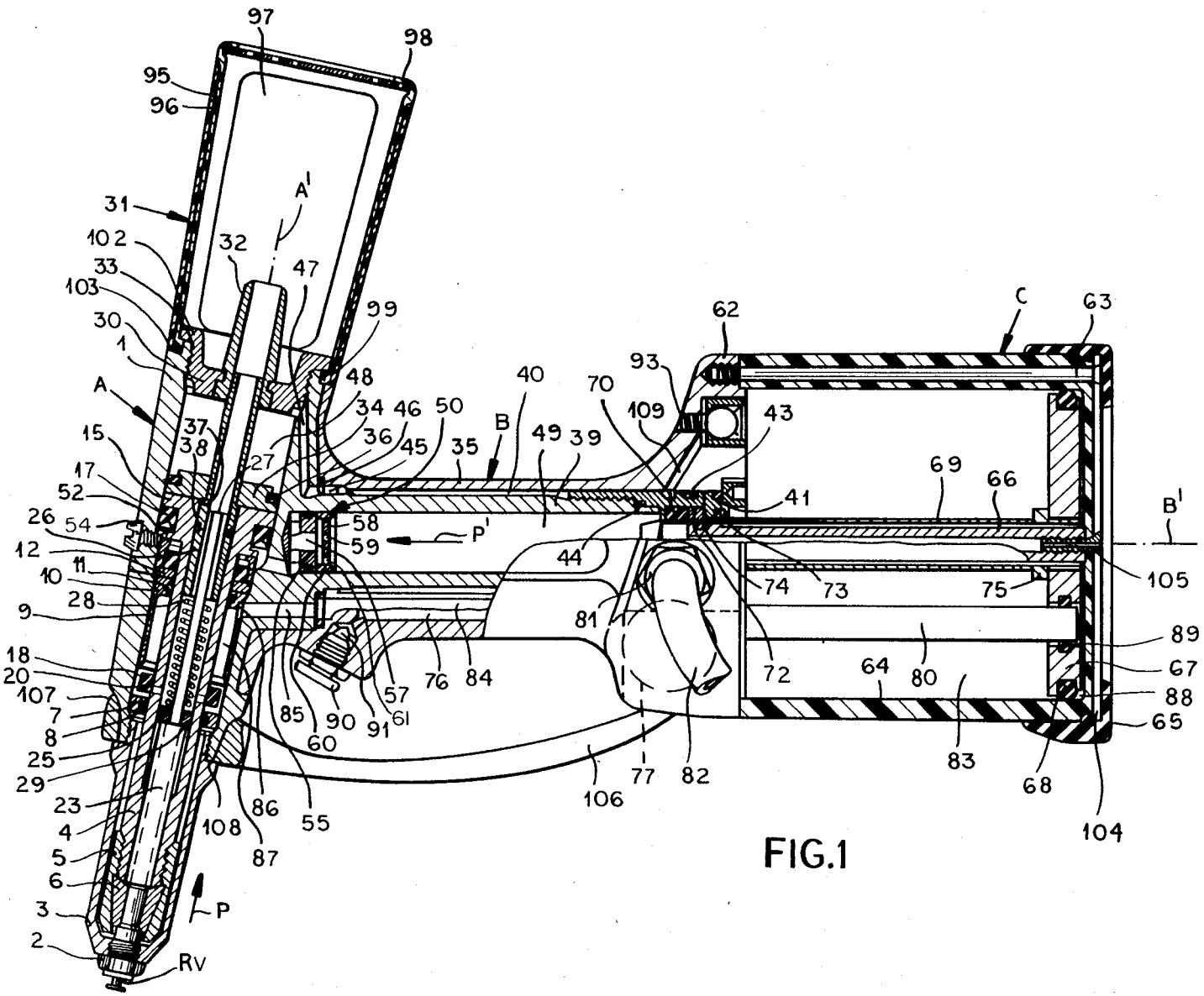
FIG. 1 is an axial section through the riveter according to this invention in the starting position.
Figure 2:
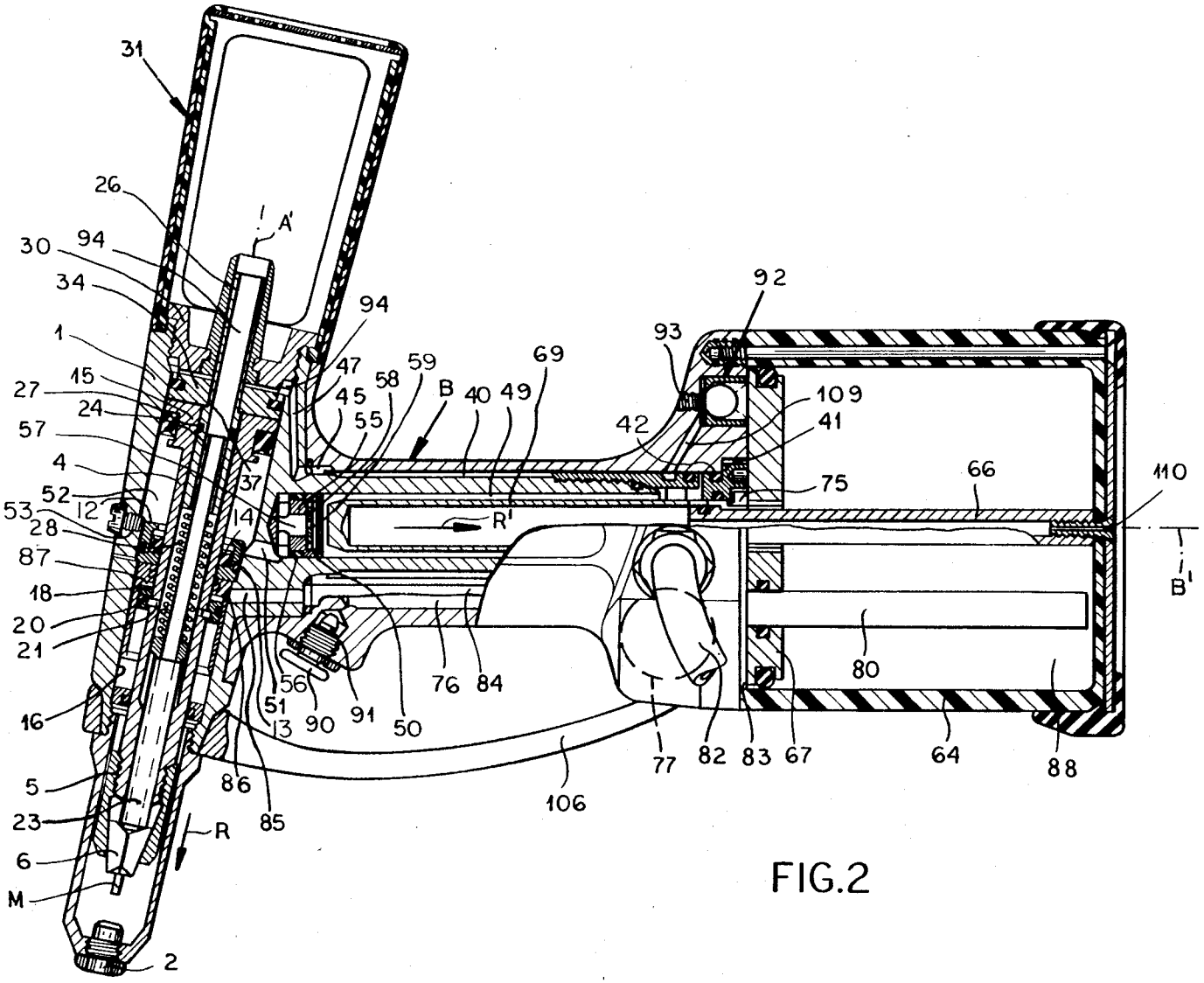
FIG. 2 is a view like FIG. 1 but showing the riveter in the ending or fully retracted position.
Figure 2A:
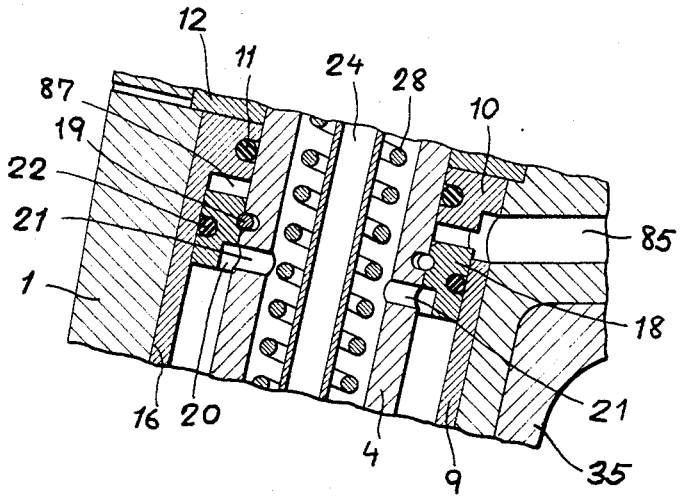

FIG. *2a* is an enlarged detail sectional view of the annular piston of the riveter in the position of FIG. 2;

FIG. *3a* is a schematic view illustrating the hydraulic operation of the riveter in the FIG. 1 position; and FIG. *3b* is a view like FIG. *3a* but showing the FIG. 2 position.

SPECIFIC DESCRIPTION

As seen in FIGS. 1 and 2 a hydropneumatic blind riveter with a mandrel catcher according to this invention generally has a head A centered on an axis A′, an intermediate handle B which forms a lopsided T with the head A and is centered on an axis B′ transverse to the axis A′, and a rear actuator C axially in line with but behind the handle B. This type of construction is standard and can be seen in above-cited U.S. Pat. Nos. 4,050,285 and 4,281,531.

The head A has a tubular body 1 having a stepped central passage or bore 16 and centered on the axis A′. This body 1 is provided on its lower end with an end piece 3 carrying a passage-forming tip 2 that is changed as rivet-mandrel size changes. The end piece 3 is screwed into the body 1 and is made of steel, whereas this body 1 is normally of hard-coated cast aluminum. A tubular pulling element 4 is displaceable along the axis A′ in the bore 16 of the body 1 and the end piece 3 and carries at its outer or lower end a chuck 5 provided internally with standard wedge-shaped self-locking jaws 6 spaced apart equiangularly about the axis A′. The element 4 is spaced radially inward of the inner surface of the bore 16 and end piece 3 and is sealed with respect to this passage 16 to form as will be described below four separate and axially spaced pressurizable chambers. Its actuation moves the chuck 5 and jaws 6 along the axis A′ from the starting position of FIG. 1 to the ending position of FIG. 2 to upset a rivet RV by pulling its mandrel M through it. The taper of the chuck 5 and jaws 6 is such that they will grip and lock on a mandrel M when the puller is moved upward or backward parallel to the axis A′ in pulling direction P, but will slide on a chuck when moved oppositely in the release direction R.

The body 1 is provided internally immediately above the end piece 3 with a seal ring 7 provided with an O-ring 8 that wipes the outer surface of the tubular puller 4. A sleeve 9 is snugly engaged in the bore 16 of the body 1 spacedly behind this ring 7 and has a radially inwardly projecting upper or rear end 10 provided with another O-ring 11 that wipes the rear portion of the puller 4. This sleeve 9 is held in place by a ring 12 that sits against a shoulder in the bore 16 and that itself is provided with an O-ring 13 that engages the wall of the bore 16 and with a piston seal 14 that wipes the exterior of the upper tube 4. The upper or rear end of the puller 4 is provided with a piston 15 having yet another seal ring 17 that wipes the inside of the bore 16 and that forms a pressurizable hydraulic chamber 52 with the ring 12.

An annular piston 18 is axially slidable on the puller 4 between the rear end 10 and seal ring 7 and is axially fixed on this puller 4 by means of a snap ring 19. The piston 18 is of the same outside diameter as the inside diameter of the sleeve 9, which therefore makes it smaller than the inside diameter of the bore 16, and it can wipe the inner surface of the sleeve 9 by means of an O-ring seal 22. Thus this piston 18 forms with the ring 7 a first pneumatic chamber and with the rear end 10 of the sleeve 9 a second pneumatic chamber 87. A cutout in the inner surface of the ring piston 18 forms an annular groove 20 surrounding the puller 4 and communicating with the interior thereof by means of bores 21 (FIG. 2) extending radially through the tubular puller 4. Thus the chamber ahead of piston 18 is continuously vented to the atmoshpere via the interior of the puller 4. In the ready position of FIG. 1, that is when the piston 18 has moved forwardly in direction R past the sleeve 9, the two chambers on opposite sides of piston 18 communicate so that both empty through the bores 21 into the unpressurized interior of the puller 4.

A jaw-pusher sleeve 23 is axially slidably guided in the front end of the puller 4 and is provided internally with an aspiration tube 24 extending with play back into a tube 26 centered on the axis A′ and axially slidable in a sleeve 32 carried in an end wall 30 of the body 1. This end wall 30 is screwed into the body 1 and sealed with respect thereto by a seal ring 33. An O-ring 38 seals between the outside of the tube 26 and the inside of the puller tube 4 and the tube 24 has a spread upper end that forms with the inner wall of the tube 26 an axially upwardly and backwardly directed nozzle 27 whose function will be described below. The tube 24 has a flange 25 lying against the rear end of the tube 23 and a helical compression spring 28 surrounds the tube 24, bearing in pulling direction P on the front of the tube 26 and in direction R on a spacer ring 29 lying on the flange 25. Thus the front end of the tube 24 is sealed at the flange 25 on the rear end of the tube 23 which itself therefore bears forward and downward on the back surfaces of the jaws 6 to give them the one-way locking action described above and well known in the art. The end plate 30 is the inner end of a mandrel-catching compartment 31 whose operation will be described below.

A piston 34 fixed on the tube 26 and engaged forwardly against a backwardly directed shoulder thereof is sealed externally against the bore 16 between the end plate 30 and the piston 15 with an O-ring 36. Immediately beneath the piston 34 the tube 26 is formed with a radially throughgoing passage 37. Thus this piston 34, which normally lies flatly against the piston 15 forms a third pneumatic chamber 48 with the end wall 30.

The working piston of the system of this invention therefore, unlike the system described in above-mentioned U.S. Pat. No. 4,050,285, is formed by the return piston 34, the pulling piston 15 formed on the puller 4, as well as the pusher tube 26. So long as the system is not pressurized the spring 28 pushes the return piston 34 and pusher tube 26 back toward the rear cover plate 30 while urging the puller 4 oppositely. Thus when the system is not connected up, the pistons 15 and 34 will be urged axially apart. This action avoids entry of air into the hydraulic chamber, as will become clear below.

The mandrel-catching compartment 31 is formed of a tapered synthetic-resin cap 95 snugly surrounded by a similarly tapered sleeve 96 that cannot move axially on it. The two elements 95 and 96 are rotatable about the axis A' relative to each other and have radially alignable windows 97 so that when these windows are aligned the compartment 31 can be emptied. The upper rim 98 of the cap 95 is fitted with a circular end plate 100 formed with perforations 101 and the lower end is formed with a rim 99 clamped against a shoulder 103 of the body 1 by the outer periphery 102 of the end plate 30. The plate 100 is made of steel and is formed with the perforations 101 in an annular array, not in the central region aligned axially with the tube 26.

The head body 1 is formed centered on the axis A' with a lateral extension 39 which is spacedly surrounded by a handle part 35 and is clamped against the head A by a locking ring 41 sealed with respect to the part 35 by rings 42 and 43 and against the extension 39 by a ring 44. The handle part 35 and extension 39 therefore form an annular passage 40 extending along and centered on the axis B'. At its front end this passage 40 is widened at 45 and sealed by a gasket 46 against the outer surface at the junction between the extension 39 and body 1. This widened end portion 45 communicates via a passage 47 with the annular chamber 48 formed between the back surface of the piston 34 and the front surface of the end plate 30, to which end the plate 30 is cut out at 94.

The extension 39 is formed with a central cylindrical bore or hydraulic chamber 49 centered on the axis B' and connected at its front end via a throttle/check valve 50 through a passage 51 (FIG. 2) to the annular chamber 52 defined in the body 1 between the front face of the piston 15 and the ring 12. The body 1 is formed with a radially throughgoing threaded hole 53 opening into the chamber 52 and normally blocked by a screw 54. This hole 53 is used to fill or refill the device with hydraulic fluid.

The valve 50 comprises a cylindrical valve body 55 engaging the wall of the chamber 49 with a seal 56 and having a central passage 57 communicating with the passage 51. This passage 57 is blocked by a throttle disk 58 having a very restricted throughgoing passage 59 and secured in place in the body 55 by a snap ring 60. Cutouts 61 in the outer periphery of the disk 58 are exposed and permit free flow into the chamber 49 from the passage 51 when pressure is greater in the latter than in the former. Flow in the opposite direction is, obviously, restricted by the small opening 59.

The rear end of the handle part 35 is formed with a flange 62 that is secured by eight angularly equispaced long screws 63 to a synthetic-resin cylinder-forming cup 64 of the actuator C. These screws 63 also secure a metal disk or end plate 104 over the base of the cup 64. An annular rubber cover or rim cap 65 is snap-fitted over the rear end of the actuator C and allows the device to be stood on its rear end, with the axis B' vertical, without marring that which it is sitting on. A tubular equalizing piston or guide 66 extending along the axis B' is secured at its rear end to the base of the cup 64 and to the plate 104 by means of a screw 105 which itself has a central axially throughgoing throttle passage 110 that vents the interior of the guide 66.

An annular pneumatic piston 67 is axially displaceable in the cup 64 and has an O-ring 68 that seals it externally against the inner wall of this cup 64 to form large diameter front and rear pneumatic chambers 83 and 88 in the cup 64. The inner diameter of the piston 67 is greater than the outer diameter of the guide 66. A tubular hydraulic piston 69 coaxially but spacedly surrounds the guide 66 and has a closed front end slidable in the chamber 49. This chamber 49 is sealed by a piston seal 70 between the ring 41 and the piston 69 from the front pneumatic chamber 83 and is sealed by the above-mentioned seal ring 44 between the outer wall of the projection 39 from the passage 40 between the projection 39 and handle part 35. A guide ring 72 for the piston 69 is provided between the seal 70 and a radially inwardly extending projection 71 of the ring 41. The side of the projection 71 turned toward the chamber 83 carries another seal ring 73 which also seals off the chamber 83. The wall of the guide 66 is thickened at its front end to correspond almost to the inner diameter of the tubular piston 69 and is provided with a seal ring 74 that wipes the inner wall of this piston 69. The rear end of the tubular guide piston 69 is formed with a radially outwardly projecting flange 75 that is fixed to and bears axially backwardly against the front face of the annular pneumatic piston 67.

Figure 3A:
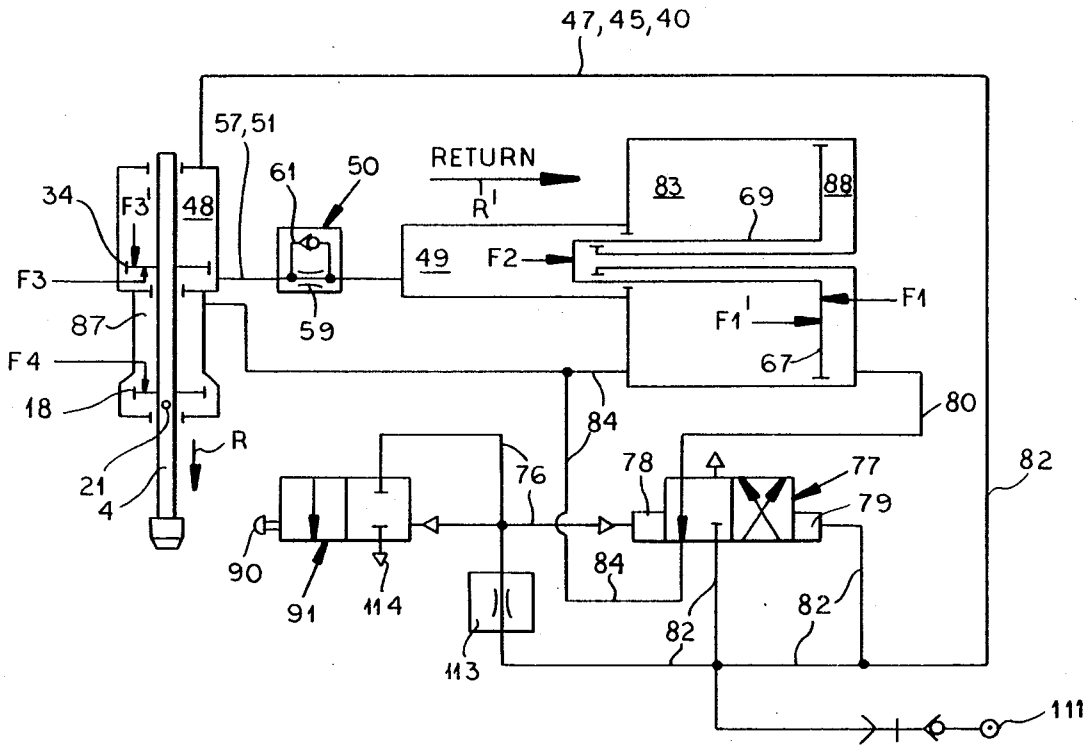
Figure 3B:
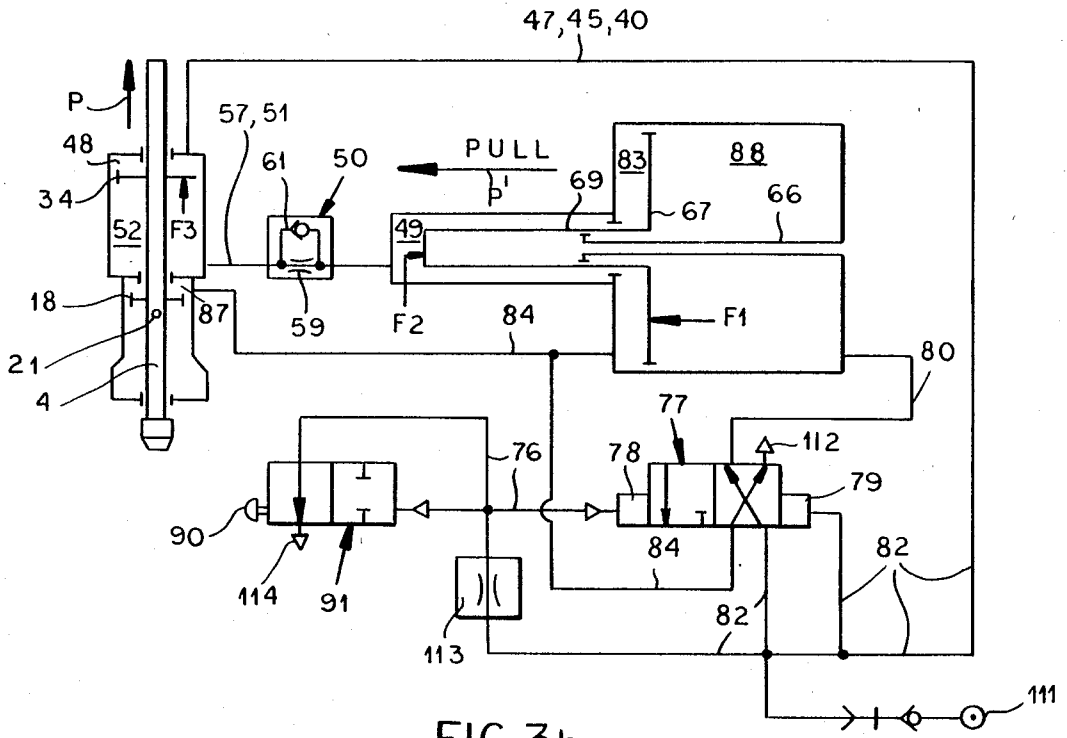

The riveter control arrangement also seen in FIGS. 3*a* and 3*b* is mainly mounted in a thickened lower region of the handle part 35. It has a pneumatically operated four-port two-position air valve 77 having opposite pilot or operating cylinder 78 and 79. An air-supply hose 82 is provided with a fitting 81 that is connected to one side of this valve 77 on the enlarged side of the flange 62 of the handle part 35. A source 111 of a gas—here air—under pressure is connected to this supply line 82. The pressure from this line 82 is applied continuously to the space 40 and thence is applied continuously via the region 45 and passage 47 to the chamber 48 to urge the pistons 34 and 15 forwardly in the body 1, and is also applied to the one pilot port or cylinder 79 of the valve 77, urging same into the position of FIG. 3*b*. The same side of the valve 77 is also connected via a passage or bore 84 in the handle part 35 to a passage 85 that opens through an opening 86 into the chamber 87 formed inside the sleeve 9, which chamber is bounded in the rear by the end part 10 of the sleeve 9 and in the front by the piston 18. In addition the bore 84 opens axially backwardly into the chamber 83 in front of the piston 67. The one port on the other side of the valve 77 is connected to a vent 112 open to the atmosphere and the other port is connected to a feed tube or conduit 80 which extends next to the axis B' through the piston 67 against which it sealed by a seal ring 89 to open into the chamber 88 to the rear of this piston 67. In the FIG. 3*a* position of the valve 77 the chamber 88 is connected to the passage 84 and the vent 112 is not connected to anything. In the FIG. 3*b* position of the valve 77 the chamber 88 is pressurized and the chambers 83 and 87 are depressurized.

The valve 77 is controlled by a two-port two-position pilot valve 91 operated by a button 90 exposed on the underside of the handle part 35 and protected by a 2cm-wide trigger guard 106 made of a synthetic resin and having at its front end a loop 107 surrounding the body 1 at a step 108 thereon. This valve 91 is connected on one side to a passage 76 also connected to the pilot port 78 and connected via a restriction 113 to the high-pressure line 82. The pilot cylinders 78 and 79 are dimensioned such that when same are under the same pressure the valve 77 will assume the Fig. 3*a* position. On the other side the valve 77 opens at 114 to the atmosphere. When the button 90 is not depressed pressure in the line 76 holds the valve 90 in the FIG. 3*a* position so that the passage 76 is not vented and the valve 77 does not pressurize the chamber 88. When the button 90 is depressed as shown in FIG. 3*b* the passage 76 is depressurized, reversing the valve 77 so that the chamber 88 is pressurized and the chambers 83 and 87 are depressurized.

An overpressure valve 92 is provided which is effective between the chamber 83 and a passage 109 extending from the passage 40. An adjustment screw 93 can hold this valve 92 slightly open at all times to allow a permanent but restricted air flow from the chamber 83 to the passage 40 and thence to the chamber 48. Of course flow in the reverse direction, provided there is a reverse pressure differential, is possible at any time.

The use of a synthetic resin for the catcher compartment 31, the trigger guard 106, the handle part 35, and the cup 64 along with the use of a light metal such as aluminum for the body 1 leaves the system quite light. Nonetheless the business parts—the puller 4, end piece 3, and various elements in the head A—are made of steel so that the system can exert a pulling force of 1.5t, making it capable of upsetting rivets of up to $\frac{1}{4}''$ in diameter. In addition the synthetic-resin parts can be produced at low cost in the desired color. A glass-reinforced polyamide such as nylon can be used.

More particularly, the riveter described above functions as follows.

Before connection to the source 111 of gas under pressure the parts of the apparatus will be in the FIG. 1 position, except that the spring 28 will have pushed the pistons 15 and 34 axially apart, thereby slightly pressurizing the fluid in the chamber 52, which with the passage 51 and chamber 49 is completely filled with incompressible hydraulic fluid. In this manner entry of air into this hydraulic system is prevented.

Connection to the source 111 will apply, regardless of the position of the valve 91, full pressure to the passage 40, which will be applied as a pneumatic force to the chamber 48 on top of the piston 34, pushing it down onto the back of the piston 15. This action compresses the spring 28 and moves the parts into the position illustrated in FIG. 1. The chamber 52 is at minimum volume and the chamber 49 at maximum volume.

Assuming the button 90 is not depressed, the front and rear compartments 83 flanking the piston 67 will be connected together and to the chamber 87 which, because of the full-forward position of the piston 18, will be vented to the atmosphere through the chamber on the other side of piston 18 and holes 21 in the puller 4, the position also shown in FIG. 3*a*. Thus the only pressurized part of the system—the chamber 48—will be stressing the only stressed part of the system—the spring 28—and will be forcing all of the other parts into the FIG. 1 position, since there is nothing to block their movement.

The mandrel M of a blind rivet RV is then pushed in direction P into the tip 2 so that the jaws 6 lock on it. The rivet RV is then fitted into the hole where it is to be upset, and the button 90 is depressed. This action reverses the valve 77 from the FIG. 3*a* position to the FIG. 3*b* position. The source 111 is connected directly to the large-diameter rear chamber 88 to exert a large force in a forward pulling direction P' on this piston 67. Meanwhile the front chamber 83 and chamber 87 connected to it by the line 84 are connected by the valve 77 to the atmosphere at 112. The pistons 67 and 69 therefore are free to move forwardly in this direction P', which will force hydraulic fluid under considerable pressure from the chamber 49 through the restriction 59 and passages 57 and 51 into the chamber 52 to exert a considerable force in the direction P on the pistons 15 and 34. As the piston 69 moves in the direction P' pressure inside it will be equalized through the tubular guide 66 vented at 110 to the atmosphere. The mandrel M will be pulled through the rivet RV, upsetting it.

As the entire puller assembly 4, 26, and 18 moves back through about a 22-mm stroke in the pulling direction P the piston 18 will enter the sleeve 9 and close off the front end of the chamber 87 so that the air forced therefrom, like the air forced from the chamber 83, will flow out through the vent 112. The surface area F1 of the rear face of the piston 67 is much larger than the surface area F3' of the rear face of the piston 34 so that the pressure in direction R is substantially greater than the opposite force effective in direction P, so that even though the chamber 48 remains pressurized, the piston 34 will move back in the direction P.

Release of the trigger with all of the parts moved into the positions of FIGS. 2 and 3*b* disconnects the source 111 from the rear chamber 88 and instead connects this rear chamber 88 to the line 84 that opens into the front chamber 83 and the chamber 87. Thus the above-described relationships are largely reversed. The chamber 87, however, will not be connected to the atmosphere since the piston 18 will be back in the sleeve 9. Thus as the pressure in the chamber 48 moves the puller 4 forwardly it forces hydraulic fluid out of the chamber 52 freely through the check/throttle valve 50 into the compartment 49, driving the pistons 69 and 67 back with considerable force. Since at the moment of switchover of the valve 77 the chamber 88 is pressurized, a considerable volume of air is therefore forced out of this chamber 88 and is fed through the valve 77 to the line 84 where it can enter the chambers 83 and 87. Thus these chambers 83 and 87 will be pressurized.

As soon as the piston 18 passes the front edge of the sleeve 9, however, it will connect the chamber 87 with the 87 through the holes 21 with the interior of the puller tube 4. The front end of this tube 4 is blocked by the pulled-off mandrel M so that this pressurized air gushes out the annular nozzle opening 27 in the direction P. A jet-pump effect is created which sucks the mandrel M in direction P out of the jaws 6, propelling it back through the tubes 24 and 26 into the catcher compartment 31, where it will strike against the unperforated center of the steel cover 100 and be trapped. This aspiration action depressurizes the line 84 along with the compartments 83, 87, 88, and 115. Air trapped between the piston 69 and the guide 66 escapes through the hole 110.

The above-described sequence of operations is possible due to the dimensioning of the varous pistons 18, 34, 67, and 69. The effective surface area F1 of the piston 67 is slightly greater than the area F1′ of its front face, largely equalized by use of the guide piston 66. The piston 69 has a surface area F2, and the pistons 15, 34 have a front-face area F3 and the rear-face area F3′. The rear face of the piston 18 has an area F4. All these piston faces are planar, and all but the face of area F2 are annular.

During the pull stroke shown in FIGS. 1 and 3*a* the force effective in direction P on the puller 4 will be equal to:

$$(F1 \cdot F3)/F3' \cdot \text{pressure} - \text{friction}.$$

During return as seen in FIGS. 2 and 3*b* the pneumatic force in direction R is equal to (F3′+F4) · pressure. This force is effective through the hydraulic fluid on the piston 69, moving it in direction R′ with a force equal to:

$$\frac{(F3' + F4) \cdot F2}{F3} \cdot \text{pressure},$$

which force is greater than the opposite force which is equal to:

$$(F1 - F1') \cdot \text{pressure}.$$

So the net force is:

$$\frac{(F3' + F4) \cdot F2}{F3} - (F1 - F1') \cdot \text{pressure} - \text{friction}.$$

Clearly, even though the chamber 48 remains pressurized, the machine can carry out this return stroke.

The screw 93 allows one to maintain a permanent suction at the end piece 2 of the riveter of this invention, which is extremely advantageous to hold a rivet in place before it is upset. Thus a permanent leak created through this valve 92 allows limited flow from the permanently pressurized passage 40 into the chamber 83 and thence, in the unactuated position of the valve 91, through the conduit 84 into the chamber 87, whence it flows out through the the chamber 87 and holes 21 into the puller 4 for a jet-pump effect at the nozzle 27.

Thus this screw 93 can be screwed in to create this permanent leak through the system to allow it to be used as a constant-pressure device, hooked up to a compressor which operates continuously without a high-pressure shutoff valve.

Removal of the tube 24 further eliminates the mandrel-recovery arrangement if that is not desired. Even tube 24 removed, however the spring 28 is left in place. In such an arrangement the entire catcher compartment 31 can be eliminated. The air under pressure from the holes 21 will therefore flow forward and backward out of the device, helping to blow a separated mandrel forwardly out of the device.

Thus the complete system according to the instant invention uses the same body of compressed air, first to upset a rivet and then to recover the mandrel, rather than wasting this compressed air or using more air for such recovery. The mandrel recovery is automatic and takes place at the end of the actuation, just before the machine is again ready to receive a new rivet and be used again. No extra steps need be taken by the operator for such an operation.

In addition the same riveter can be set up not to recover the mandrel, and can be arranged for constant or intermittent air feed. A simple adjustment makes it capable of holding a rivet in place by suction. The device is versatile and simple.

I claim:

1. A blind riveter comprising:

a housing forming an air chamber and a liquid-filled hydraulic chamber adjacent thereto;

a head on said housing having a tip and forming a liquid—filled working chamber communicating with said hydraulic chamber;

a working piston in said working chamber and carrying a chuck for grasping a mandrel of a blind rivet, said head and chuck forming a passage having a front end opening at said tip and a rear end, said piston being displaceable in said working chamber between a ready position juxtaposed with said tip and wherein a mandrel of a blind rivet can be fitted into said passage at said chuck with said rivet engaged backwardly against said tip and an actuated position spaced from said tip and wherein said chuck is retracted;

a generally closed mandrel-catching compartment on said head, said other end of said passage opening into said compartment;

an air piston in said air chamber;

a hydraulic piston carried on said air piston and displaceable in said hydraulic chamber between an advanced position pressurizing said hydraulic chamber and corresponding to a front position of said air piston and a retracted position corresponding to a rear position of said air piston;

means for pressurizing said air chamber and thereby moving said air and hydraulic pistons into the respective front and advanced positions for pressurizing said working chamber and displacing said chuck from said ready to said actuated position, whereby on displacement of said chuck from said ready to said actuated position the mandrel is pulled off the rivet at said tip;

a nozzle directed in said passage toward said other end; and a valve means connected between said air chamber and said passage for feeding air under pressure from said air chamber to said nozzle after displacement of said chuck from said actuated into said ready position and for thereby simultaneously sucking the pulled-off mandrel from said chuck back along said passage into said compartment, said chuck including an inner mandrel tube extending back toward said other end and having an end forming part of said nozzle, said chuck including an outer mandrel tube spacedly surrounding said inner tube and forming said nozzle therewith, and a spring being braced between said mandrel tubes and urging said inner tube into engagement with said chuck and said outer tube oppositely, said head being provided with a mandrel-tube piston carrying said outer mandrel tube and displaceable therewith toward and away from said tip.

2. The blind riveter defined in claim 1 wherein said chuck carries a second air piston distinct from the first-mentioned air piston and said head is formed around said second air piston with a second air chamber distinct from the first-mentioned air chamber, said chuck including a puller tube fixed to said second air piston and to said working piston and surrounding said mandrel tubes, said valve means being connected between said air chambers and connecting same together on displacement of said chuck from said actuated to said ready position, said second air piston being displaceable through an intermediate position corresponding to an intermediate position of said chuck between said chuck and ready positions, said second air chamber being connected to said nozzle between said intermediate position and said ready position of said chuck.

3. The blind riveter defined in claim 2 wherein said second air chamber has a small-diameter rear portion distal from said tip and in which said second air piston fits snugly and a large-diameter front portion proximal to said tip and larger than said second air piston, said first air chamber being connected to said second air chamber at said rear portion, said piston lying between said portions in its said intermediate position, said puller tube being formed with at least one radially throughgoing hole opening into said large-diameter portion, whereby when said piston is in said front portion air can flow from said rear portion through said hole into said puller tube.

4. The blind riveter defined in claim 3 wherein said inner mandrel tube is constructed and arranged to be removable from said head.

5. The blind riveter defined in claim 1 wherein said mandrel-catching compartment is open to the atmosphere.

6. The blind riveter defined in claim 5 wherein said compartment is formed with vent holes smaller in diameter than said mandrel.

7. The blind riveter defined in claim 5 wherein said compartment has an inner part formed with a window and an outer part also formed with a window and movable on said inner part between a position with said windows aligned for emptying out mandrels and a position with said windows out of alignment.

8. The blind riveter defined in claim 6 wherein said compartment is fixed on said head.

9. The blind riveter defined in claim 7 wherein said compartment has a metallic end plate aligned with said passage and formed with holes out of alignment with said passage.

10. The blind riveter defined in claim 1, further comprising valve means for continuously feeding a small quantity of air under pressure to said nozzle, whereby suction is created at said tip.

11. The blind riveter defined in claim 1 wherein said air piston subdivides said air chamber into a front air chamber and a rear air chamber and is displaceable between a front position of maximum volume of said rear air chamber and minimum volume of said front air chamber and a rear position of minimum volume of said rear air chamber and maximum volume of said front air chamber, said air piston having a front face exposed in said front air chamber and from which said hydraulic piston projects and a rear face exposed in said rear air chamber and of generally the same effective surface area as said front face.

12. The blind riveter defined in claim 11, further comprising a guide piston extending through said rear air chamber and air piston into said hydraulic piston, said guide piston being of slightly smaller cross section than said hydraulic piston.

13. The blind riveter defined in claim 12, wherein said rear air chamber has an end wall to which said guide piston is fixed.

14. The blind riveter defined in claim 10 wherein said working piston forms with said head another air chamber pressurizable to urge said chuck into said ready position, said riveter including conduit means connected to said other air chamber for continuously maintaining same pressurized with a gas.

15. A blind riveter comprising:

a housing forming an air chamber and a liquid-filled hydraulic chamber adjacent thereto;

a head on said housing having a tip and forming a liquid—filled working chamber communicating with said hydraulic chamber;

a working piston in said working chamber and carrying a chuck for grasping a mandrel of a blind rivet, said head and chuck forming a passage having a front end opening at said tip and a rear end, said piston being displaceable in said working chamber between a ready position juxtaposed with said tip and wherein a mandrel of a blind rivet can be fitted into said passage at said chuck with said rivet engaged backwardly against said tip and an actuated position spaced from said tip and wherein said chuck is retracted;

a generally closed mandrel-catching compartment on said head, said other end of said passage opening into said compartment;

an air piston in said air chamber;

a hydraulic piston carried on said air piston and displaceable in said hydraulic chamber between an advanced position pressurizing said hydraulic chamber and corresponding to a front position of said air piston and a retracted position corresponding to a rear position of said air piston;

means for pressurizing said air chamber and thereby moving said air and hydraulic pistons into the respective front and advanced positions for pressurizing said working chamber and displacing said chuck from said ready to said actuated position, whereby on displacement of said chuck from said ready to said actuated position the mandrel is pulled off the rivet at said tip a nozzle directed in said passage toward said other end; and valve means connected between said air chamber and said passage for feeding air under pressure from said air chamber to said nozzle after displacement of said chuck from said actuated into said ready position and for thereby simultaneously sucking the pulled-off mandrel from said chuck back along said passage into said compartment, said chuck including an inner mandrel tube extending back toward said other end and having an end forming part of said nozzle, said air piston subdividing said air chamber into a front air chamber and a rear air chamber and is displaceable between a front position of maximum volume of said rear air chamber and minimum volume of said front air chamber and a rear position of minimum volume of said rear air chamber and maximum volume of said front air chamber, said air piston having a front face exposed in said front air chamber and from which said hydraulic piston projects and a rear face exposed in said rear air chamber and of generally the same effective surface area as said front face, said chuck carrying a second air piston distinct from the first-mentioned air piston and said head is formed around said second air piston with a second air chamber distinct from the first-mentioned air chamber and permanently communicating with said front air chamber, said chuck including a puller tube fixed to said second air piston and to said working piston, said valve means being connected between said second air chamber and said rear air chamber and connecting same together on displacement of said chuck from said actuated to said ready position, said second air piston being displaceable through an intermediate position corresponding to an intermediate position of said chuck between said chuck and ready positions, said second air chamber being connected to said nozzle between said intermediate position and said ready position of said chuck.

16. In a pneumatic hydraulic blind riveter for setting a blind rivet having a sleeve and a mandrel withdrawable from said sleeve upon the setting of the rivet, the blind riveter comprising a chuck engageable with said mandrel, a pneumatic piston connected to said chuck for displacing same into a position enabling said chuck to grip said mandrel, a hydraulic piston connected to said chuck and hydraulically displaceable to enable said chuck to draw said mandrel through said sleeve and set the rivet, a pneumatic-hydraulic force multiplying device including a pneumatic chamber and a hydraulic chamber, said hydraulic chamber being connected to pressurize said hydraulic piston, and means for discharging a mandrel removed from a respective sleeve after setting of the rivet in an air stream, the improvement which comprises a control valve connected by pneumatic lines to said pneumatic chamber and to said pneumatic piston for generating said air stream by venting said pneumatic chamber through said valve.

* * * * *